US005148923A

United States Patent [19]

Fraenkel et al.

[11] Patent Number: 5,148,923

[45] Date of Patent: Sep. 22, 1992

[54] APPARATUS FOR SORTING OR OTHERWISE TREATING OBJECTS

[75] Inventors: Herbert Fraenkel, London; Stewart J. Mills, Essex, both of England

[73] Assignee: Sortex Limited, London, England

[21] Appl. No.: 656,486

[22] Filed: Feb. 15, 1991

[30] Foreign Application Priority Data

Feb. 19, 1990 [GB] United Kingdom ..... 9003698

[51] Int. Cl.[5] ..... B07C 5/02; B07C 5/342

[52] U.S. Cl. ..... 209/539; 198/445; 209/557; 209/580; 209/631; 209/639; 209/922

[58] Field of Search ..... 209/44.1, 44.2, 539, 209/557, 576–578, 580, 581, 629, 631, 638, 639, 642, 644, 908, 922, 923, 932, 933; 198/445, 446

[56] References Cited

U.S. PATENT DOCUMENTS

| | | | |
|---|---|---|---|
| 2,696,297 | 12/1954 | Matthews, Jr. | 209/539 X |
| 4,074,807 | 2/1978 | Goulds | 198/445 X |
| 4,356,921 | 11/1982 | Fraenkel | 209/576 |
| 4,365,717 | 12/1982 | Stone | 198/445 X |
| 4,373,638 | 2/1983 | Schapper | 209/639 X |
| 4,385,700 | 5/1983 | Hodges et al. | 209/539 |
| 4,933,075 | 6/1990 | Nordin et al. | 209/576 |

FOREIGN PATENT DOCUMENTS

| | | | |
|---|---|---|---|
| 0066069 | 3/1969 | Fed. Rep. of Germany | 209/557 |
| 0350773 | 10/1937 | Italy | 209/642 |
| 0076772 | 11/1954 | Netherlands | 209/576 |

*Primary Examiner*—Michael S. Huppert
*Assistant Examiner*—Edward M. Wacyra
*Attorney, Agent, or Firm*—Palmatier & Sjoquist

[57] ABSTRACT

An apparatus for sorting or otherwise treating objects, wherein the apparatus includes an endless belt which is in contact with a guide by means of which the endless belt is given a curved portion. At least one path between the guide and the curved portion of the belt is provided for the passage of objects therethrough. The path has an inlet portion arranged to receive objects which have traveled thereto along a trajectory which has a substantial horizontal component at the inlet portion, and the path has a vertically disposed outlet portion. A feeder is provided for feeding the objects to the inlet portion of the path. The belt is driven so that objects passing into the path through the inlet portion thereof are centrifugally forced against the belt and carried thereby to the respective outlet portions. The objects are sorted or otherwise treated as they fall under gravity from the outlet portion.

16 Claims, 3 Drawing Sheets

APPARATUS FOR SORTING OR OTHERWISE TREATING OBJECTS

This invention concerns an apparatus for sorting or otherwise treating objects, the term "objects" being used in this specification in a broad sense as including, inter alia, agricultural products, such as peas and beans, and particulate material, such as pieces of mineral ore.

BACKGROUND OF THE INVENTION

In U.S. Pat. No. 4,074,807, there is disclosed an apparatus in which such objects are fed to a horizontally extending run of an endless belt where they pass beneath an examination apparatus which, together with a control apparatus, determines whether the objects have a certain characteristic or characteristics, and then separates the objects into different streams in dependence upon whether they have or fail to have such characteristics.

In the previously known apparatus, however, since the objects are viewed while on the said horizontally extending run, they can in practice only be viewed from above since, if they are also viewed from below, any viewing means disposed below the horizontally extending run will quickly be affected by any liquid or debris associated with the objects and will therefore become non-functional. Even if the objects are viewed from below after leaving the horizontally extending run, the viewing means are likely to become quickly non-functional.

SUMMARY OF THE INVENTION

An object of the present invention is to provide a satisfactory apparatus in which the objects may be viewed from below.

Another object of the present invention is to ensure that there is correct alignment in a sorting machine between lines of objects being sorted and ejectors used for removing undesired objects from such lines.

According, therefore, to one aspect of the present invention, there is provided apparatus for sorting or otherwise treating objects comprising an endless belt which is in contact with guide means by means of which the endless belt is given a curved portion; means for forming at least one path between the guide means and the curved portion of the belt for the passage of the objects therethrough, the or each path having an inlet portion arranged to receive objects which have travelled thereto along a trajectory which has a substantial horizontal component at the inlet portion, and the or each path having a vertically disposed outlet portion; feeding means for feeding the objects to the inlet portion of the or each path; means for driving the belt so that objects passing into the or each path through the inlet portion thereof are centrifugally forced against the belt and carried thereby to the respective outlet portion; and means for sorting or otherwise treating the objects as they fall under gravity from the or each outlet portion.

Thus, in the case of the present invention, the means for sorting or otherwise treating the objects can be horizontally spaced from the stream of objects falling under gravity from the or each outlet portion and can therefore be disposed in a position in which it will be relatively unaffected by any such liquid or debris.

The guide means may comprise a drum which has a plurality of circumferentially extending grooves which, together with the said belt, form the said paths.

Alternatively, the guide means may comprise at least one stationary guide member provided with a cover member which is movable with respect to its stationary guide member, the or each cover member being engaged by the belt so as to be frictionally driven thereby over the respective stationary guide member.

The belt is preferably stiffer axially of the guide means than it is circumferentially thereof. Thus, for example, a portion of the belt may have substantially axially extending threads of relatively inextensible material and substantially circumferentially extending threads of relatively extensible material.

The said belt may be entrained around pulleys or rollers at least one of which is resiliently urged towards a normal operating position but which can be forced away therefrom to permit an oversize object to pass through a said path without damaging the latter.

The said feeding means preferably comprises a second endless belt having a substantially horizontal run between whose downstream end and the or each said path there is a space through which undesired objects and/or other material can be removed, and means for driving the second endless belt, the remaining objects passing across said space, on the said trajectory, from the second endless belt to the or each inlet portion.

At least one barrier may be mounted in said space for impingement by the said undesired objects and/or by other material so that the latter may be removed through said space.

There may be guides or partitions above at least part of the horizontal run of the second endless belt, the guides or partitions being aligned with the walls of the said grooves.

Preferably there are divider means disposed transversely of the horizontal run for dividing the latter into a plurality of separate longitudinally extending paths through which the objects may travel to corresponding paths which extend circumferentially of a portion of the guide means, there being alignment means for maintaining the paths on the horizontal run in operative alignment with those extending circumferentially of a portion of the guide means.

The alignment means preferably comprise means for preventing transverse movement of the second endless belt.

The second endless belt preferably runs over at least one roller which has at least one groove therein which receives a projection or projections on the second endless belt.

The divider means preferably comprise a plurality of endless bands having substantially horizontal runs which are spaced apart transversely of the second endless belt so as to constitute side walls of the paths on the latter, the endless bands and the second endless belt being driven at substantially the same speed.

Preferably, at least portions of the endless bands and of the second endless belt are in driving frictional contact.

Each of the endless bands preferably runs over at least one roller which has a respective groove therein, the groove receiving a portion of the endless band so as to prevent transverse movement of the latter.

Preferably, the width of each path on the horizontal run is less than that of the respective path which extends circumferentially of a portion of the guide means.

The feeding means may comprise means for removing water or other liquid from the objects.

The apparatus may comprise sensing means for sensing the objects as they fall under gravity; and separating means, controlled by signals from the sensing means, for separating the falling objects into a plurality of different streams in dependence upon the respective characteristics of the objects. Thus the sensing means may comprise electro-optical scanning means. Such electro-optical scanning means are preferably horizontally spaced from the falling objects by a distance such that they are substantially protected from debris associated therewith.

The electro-optical scanning means may effect scanning in a plurality of different directions.

The separating means may comprise a pneumatic ejector which is disposed below the scanning means.

The invention also comprises a method of sorting or otherwise treating objects comprising feeding the objects to an inlet portion of at least one path between an endless belt and guide means by means of which the endless belt is given a curved portion, the objects being so fed along a trajectory which has a substantial horizontal component at the said inlet portion, the or each path having a substantially vertically disposed outlet portion; driving the belt so that objects passing into the or each path through the inlet portion thereof are centrifugally forced against the belt and carried thereby to the respective outlet portion; and sorting or otherwise treating the objects as they fall under gravity from the or each outlet portion.

The belt is preferably driven at a speed substantially the same as that of the objects passing through the or each inlet portion.

According to another aspect of the present invention, there is provided a sorting machine comprising an endless belt having a substantial horizontal run; drive means for driving the endless belt; divider means which are spaced apart transversely of the horizontal run for dividing the latter into a plurality of separate longitudinally extending paths for the objects; a plurality of ejectors disposed downstream of the endless belt for removing undesired objects; alignment means for maintaining the paths and the ejectors in operative alignment; and means for delivering the objects to upstream portions of said paths so that in operation the objects are carried by the endless belt to downstream portions of said paths where they leave the endless belt and subsequently pass the ejectors.

Other objects, features and advantages of the present invention will be understood with reference to the following specification and appended drawings and claims.

DETAILED DESCRIPTION OF THE PREFERRED EMBODIMENTS

Figure 1:
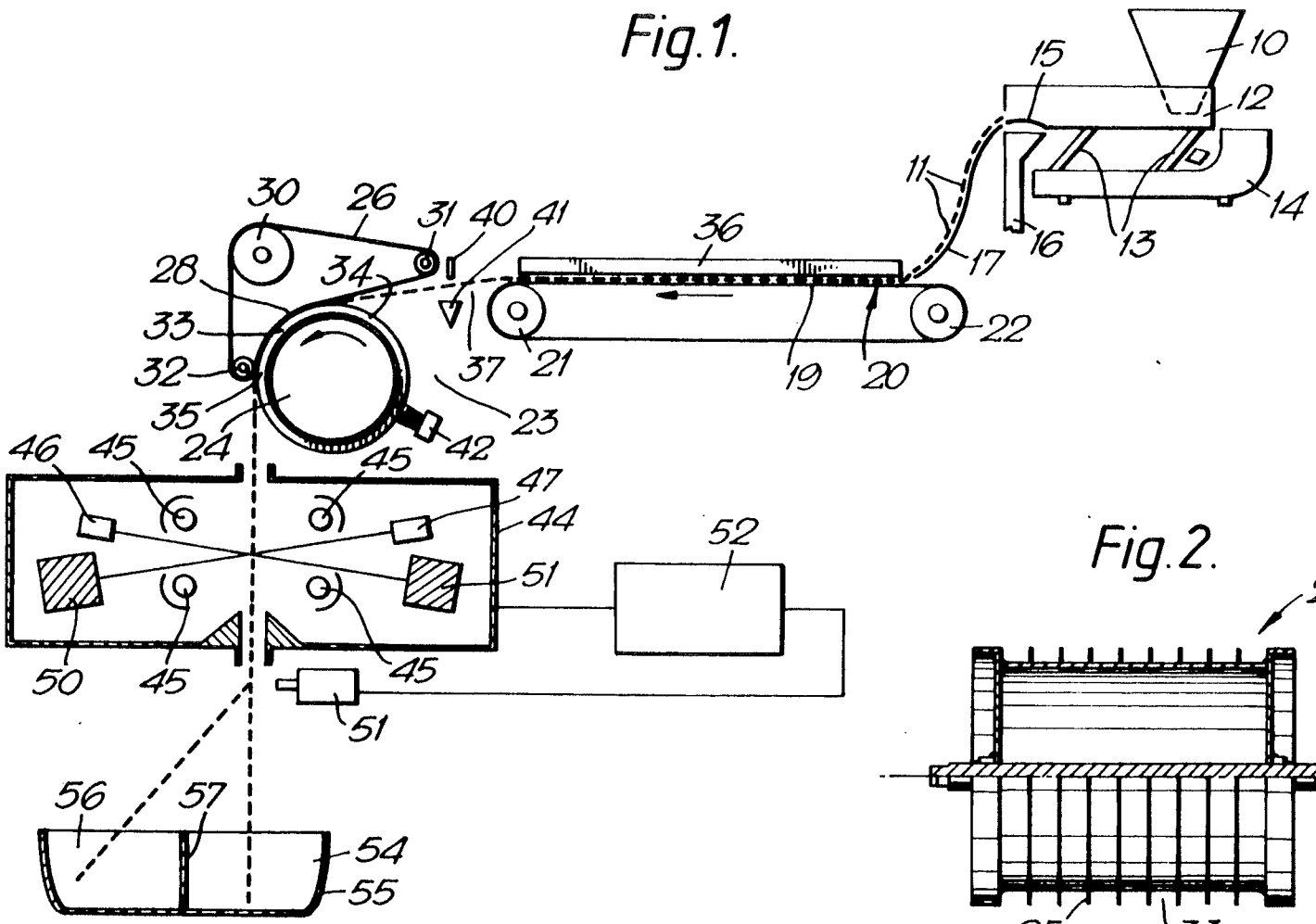
FIG. 1 is a schematic side view of a first embodiment of an apparatus for sorting or otherwise treating objects according to the present invention.
Figure 2:
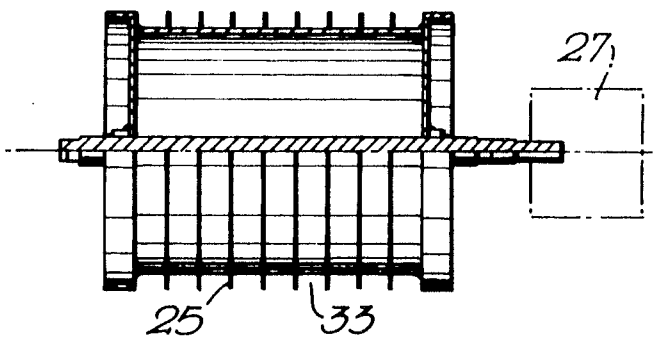
FIG. 2 is a view, partly in elevation and partly in section, of a drum forming part of the apparatus of FIG. 1.

Referring to FIGS. 1 and 2 of the accompanying drawings, a first embodiment of a sorting machine for sorting agricultural products such as peas or beans (or other objects such as mineral ore) comprises a hopper 10 to which objects 11 which are associated with water or other liquid have been supplied by means not shown. Thus the objects 11 may be constituted by peas or beans which are wet as a result of having been cooked in water some of which is still associated with them.

The objects 11 fall from the hopper 10 into a tray 12 which may be slightly inclined downwardly. The tray 12 is supported by leaf spring or other support members 13 on an electro-magnetic vibrator 14 which causes vibration of the tray 12 such that the objects are fed from the bottom of the hopper 10 to a dewatering grid 15 which forms part of the lower wall of the tray 12. Much of the water which is associated with the objects 11 passes through apertures in the dewatering grid 15 and into a pipe 16 of a dewatering device (not shown). The objects 11, which have passed over the dewatering grid 15, then travel down a chute 17 so as to pass onto an upper substantially horizontal run 19 of an horizontally extending endless belt 20 which is entrained between an idler pulley 21 and a driven pulley 22, the idler pulley 21 and driven pulley 22 being respectively arranged at the downstream and upstream end portions of the endless belt 20.

Disposed adjacent to the pulley 21 but separated from the latter by a space 23 are guide means comprising an hollow drum 24 which is disposed downstream of the endless belt 20 and which, as best seen in FIG. 2, is grooved to provide a plurality of circumferentially extending walls or castellations 25.

Mounted above the drum 24 there is an endless belt 26 which is entrained around a pulley 30 and two spaced apart relatively small diameter pulleys 31, 32.

A part of the endless belt 26 is in driving contact with an arcuate portion of the drum 24 so that the latter causes the endless belt 26 to be given a curved portion 28. Either the pulley 30 or the drum 24 is arranged to be rotated so that the drum 24 and the endless belt 26 are driven in unison. Thus the drum 24 may be rotated by a motor shown diagrammatically at 27 (FIG. 2), the drive from the drum 24 being frictionally transmitted to the endless belt 26. Moreover, the motor 27 may be arranged (by means not shown) to drive the driven pulley 22.

The walls 25 define with the drum 24 and the endless belt 26 a plurality of grooves, paths or channels 33 which extend circumferentially of a portion of the drum 24 and which are adapted for the passage of the objects 11 therethrough. Each of the paths 33 has an inlet portion 34 and a substantially vertically disposed outlet portion 35. Each inlet portion 34 is arranged to receive the objects 11 which have travelled thereto along a trajectory 37 which has a substantially horizontal component. The belt 26 is driven at a speed substantially the same as that of the objects 11 passing through the inlet portion 34.

Above at least part of the horizontally extending endless belt 20 there are mounted (by means not shown) a plurality of horizontally spaced apart stationary guides or partitions 36 which are respectively aligned with the walls 25 of the paths 33 so as to prevent the objects 11 from striking the walls 25. The guides or partitions 36 thus divide the horizontal run 19 into a plurality of separate longitudinally extending paths through which the objects 11 may travel to the corresponding paths 33, the paths on the horizontal run 19 being aligned with and narrower than the paths 33.

The objects 11, which comprise both objects of predetermined density, mass or configuration and those of some different density, mass or configuration, are thus arranged on the horizontally extending endless belt 20 in the form of a plurality of parallel horizontally extending lines or bands of objects which are disposed in a common plane. The latter may therefore form either a relatively wide "sheet" of objects 11 or more singulated lines or bands of objects 11. Each such line or band of objects 11 travels across the space 23 from the horizontally extending endless belt 20 to the respective inlet portion 34 of the respective path 33 and may, for example, enter the latter at an angle of preferably at least 45° to the vertical. Mounted moreover in the said space 23 is an upper barrier 40 which is disposed above the trajectory of the said objects 11 of a predetermined density, mass or configuration which pass from the horizontally extending endless belt 20 to the said inlet portions 34, and a barrier 41 which is mounted below this trajectory.

Objects which are of substantially lower density etc. than the objects 11 for which the apparatus is designed will have insufficient momentum to pass across the space 23 and will thus tend to fall through the space 23 from which they are removed by means not shown. Oversize objects 11, together with debris associated therewith, will tend to impinge on either the barrier 40 or the barrier 41 with the result that they too will fall through the space 23.

At least one of the relatively small diameter pulleys 31, 32 may be resiliently urged (by means not shown) towards the normal operating position illustrated in FIG. 1, the arrangement being such that the pulley is capable of being forced away from this operating position so as to permit an oversize object 11 to pass through a path 33 without damaging the latter. This may be achieved by providing springs between the bearings of the pulleys 31, 32 and stops (not shown).

A drum cleaning brush 42 may as shown be provided to effect cleaning of the drum 24.

The objects 11 which pass into the paths 33 through the inlet portions 34 are centrifugally forced against the belt 26 and are carried thereby to the outlet portions 35 of the paths 33. Thus the objects 11 which have passed through the outlet portions 35 will fall under gravity vertically from the belt 26 in the form of a plurality of parallel lines which are aligned with the paths 33.

In order to assist the effectiveness of the belt 26, it is desirable that the belt 26 is stiffer axially of the drum 24 than it is circumferentially thereof.

Thus, for example, if the belt 26 has a canvas portion which is moulded into a belt which is otherwise made of plastics or rubber material, the canvas could be woven with relatively elastic threads (e.g. of rubber) in the circumferential direction and relatively inelastic threads (e.g. of cotton) in the axial direction. Another possibility would be to provide the belt 26 with axially extending stiffening ribs. The use of a belt 26 having such differential stiffness helps to ensure that when the objects 11 pass the pulley 32, which may be disposed as shown at the horizontal diameter, or mid-height, of the drum 24, there will be a substantially consistent release of the products 11 for subsequent sorting.

Figure 3:
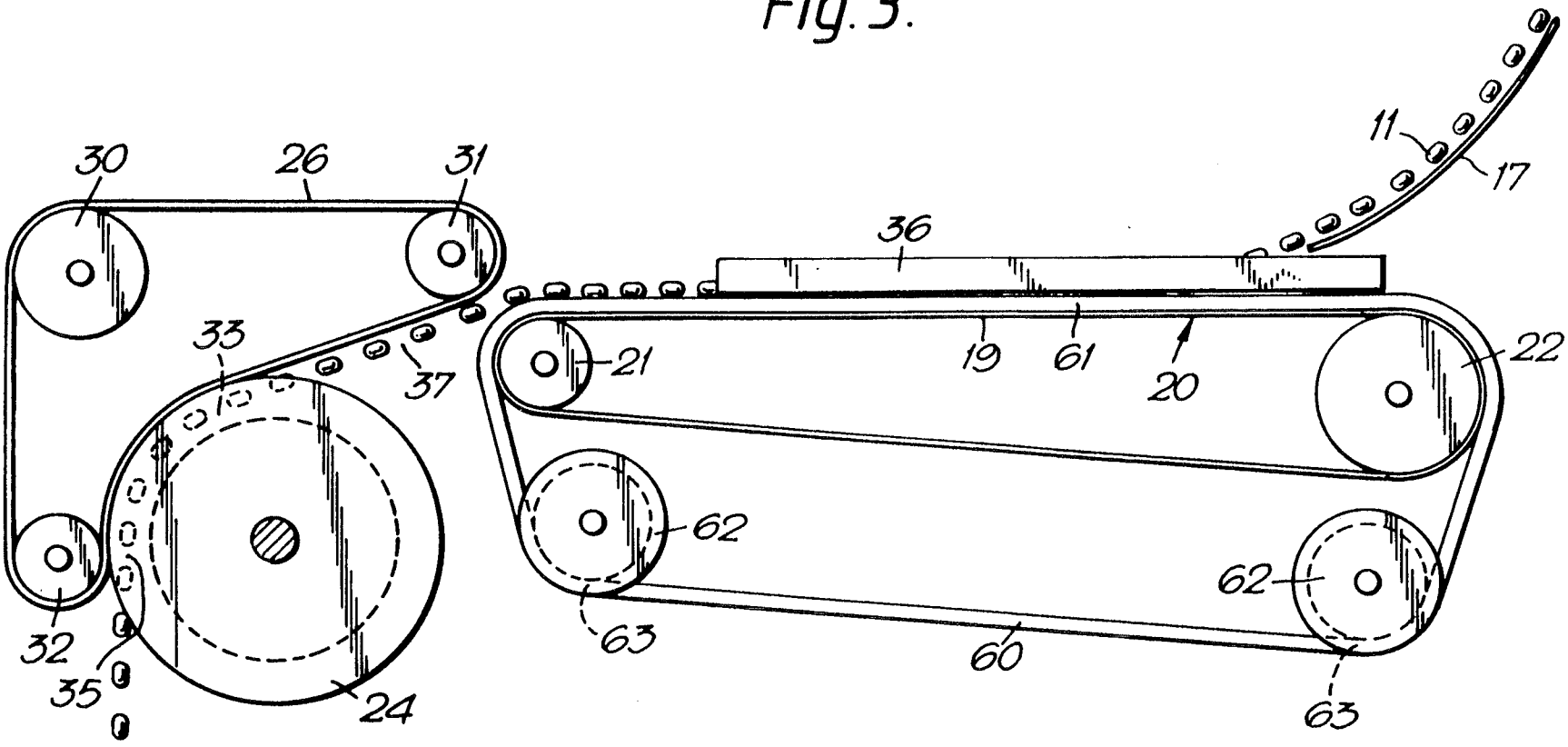
FIG. 3 is a schematic side view of a part of a second embodiment of an apparatus for sorting or otherwise treating objects according to the present invention.

Although the pulley 32 is shown in FIGS. 1 and 3 as being disposed at the horizontal diameter, or mid-height, of the drum 24, it may be desirable in some cases to align it horizontally with the bottom of the drum 24, e.g. to reduce horizontal wander of the objects 11 leaving the outlet portions 35.

In order to get maximum capacity for the apparatus, it is desirable that the number of paths 33 should be reduced as much as possible, e.g. to eight or nine.

Disposed below the drum 24 is a viewing chamber 44 through which pass the vertically falling objects 11. Mounted in the viewing chamber 44 are four lamps 45 for illuminating the objects 11, the lamps 45 being disposed on opposite sides of the path of the falling objects 11. Two electro-optical scanning cameras 46, 47 are respectively disposed on opposite sides of said path. The scanning cameras 46, 47 and lamps 45 are horizontally spaced from the falling objects 11 by a distance such that they are substantially protected from debris associated with the latter. Each of the scanning cameras 46, 47 views the falling objects 11 in a respective direction of viewing, the viewing being effected against a respective background 50, 51. The backgrounds 50, 51, as is well known, are arranged to have a colour similar to that which should be possessed by the objects 11 so that electrical signals produced by the scanning cameras 46, 47 will be substantially unaffected by the size of the objects 11 being viewed and will merely be indicative of their colour. The outputs from the scanning cameras 46, 47 are transmitted to an electronic control circuit or circuits 52 where they are compared with predetermined data and, where necessary, operate one of a plurality of pneumatic ejectors 53 which are disposed below the chamber 44 and form an ejector bank.

If an ejector 53 is inoperative, the respective objects 11 fall vertically into a compartment 54 of a product reservoir 55. If, however, the control circuit or circuits 52 senses an object 11 which does not have the same characteristics as those which are to be collected in the compartment 54, the respective ejector 53 is actuated so as to direct a stream of air onto the object concerned and thus deflect it into a compartment 56 of the reservoir 55. The reservoir 55 has an internal division 57 to separate the compartments 54, 56 from each other.

It will be appreciated that the electro-optical viewing chamber 44 may if desired be replaced by radiation-sensitive, magnetic-sensitive or other sorting devices.

It is desirable to ensure that the paths on the endless belt 20 are at all times operatively aligned with the corresponding paths 33. Although the endless belt 20 could be provided for this purpose with a plurality of transversely spaced apart wall members or castellations which could be fixed to or be formed integrally with the endless belt 20 so as to form side walls of the paths on the latter, this would not of itself maintain the desired alignment unless relative transverse movement of the endless belt 20 and the drum 24 could be prevented. Such relative transverse movement can, for example, occur because of movement of the endless belt 20 transversely of the pulleys 21, 22. In order, therefore, to prevent such transverse movement of the endless belt 20, the underside of the latter may be provided with one or more projections such as longitudinally extending walls or castellations (not shown) which are received in corresponding grooves in the pulleys 21, 22. Such a construction, however, may not be suitable unless the pulleys 21, 22 are relatively large since otherwise any groove therein will necessarily be rather shallow and may not therefore adequately grip the projection or projections on the endless belt 20. Moreover, if the pulley 21 is relatively small, as it may need to be to provide accurate release of certain moist products, the endless belt 20 will have a small radius of curvature as it passes around the pulley and this may put a considerable strain on the projection or projections on the endless belt 20.

A further construction of the present invention is therefore shown in FIG. 3 which illustrates part of a second embodiment of an apparatus according to the present invention. The FIG. 3 construction, however, is generally similar to that of FIGS. 1 and 2 and consequently will not be described in detail, like reference numerals indicating like parts.

In the FIG. 3 construction, however, a plurality of endless bands 60 have substantially horizontal runs 61 which are spaced apart transversely of the horizontal run 19 of the endless belt 20 and frictionally contact the latter so as to be driven thereby at substantially the same speed. The endless bands 60, together with the stationary guides 36, constitute side walls of the paths on the upper run 19 for the passage of the objects 11 from the chute 17. Each of the endless bands 60 runs over grooved tensioning rollers or pulleys 62 which are disposed below the endless belt 20, each of the pulleys 62 having a groove 63 therein for receiving a portion of the respective endless band 60 as it passes around the pulley. The pulleys 62 prevent transverse movement of the respective endless bands 60 and therefore ensure that the paths on the horizontal run 19 are maintained in operative alignment with the paths 33 which are somewhat narrower and also in operative alignment with the respective ejectors 53.

The guides 36 may be constituted by pins or deflectors which prevent the objects 11 resting on them.

The endless bands 60 could, if desired, contact the endless belt 20 throughout their length, in which case the pulleys 62 could be disposed beneath the endless bands 60 and engage the latter from below. Alternatively, the endless bands 60 could be disposed entirely above the endless belt 20 and have a lower run frictionally contacting the horizontal run 19.

Each of the bands 60 may be made of a length of plastics or rubber material whose ends have been welded together. The cross section of each of the bands 60 need not necessarily be circular since it may alternatively be square or triangular or of other shape.

Figure 4:
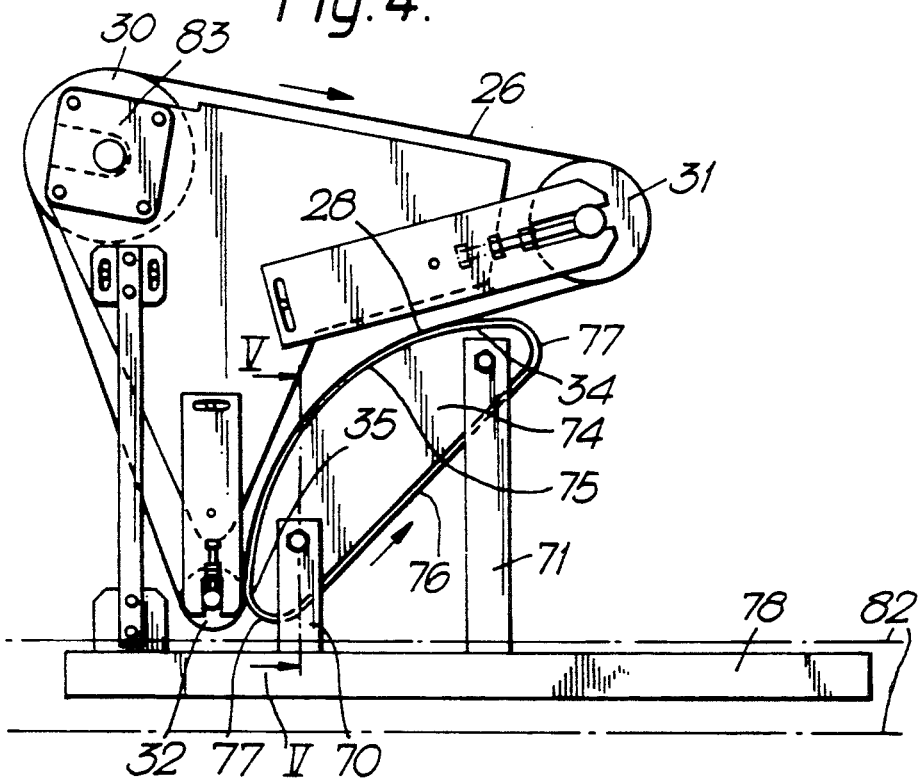
FIG. 4 is a side view of part of a third embodiment of an apparatus for sorting or otherwise treating objects according to the present invention.
Figure 5:
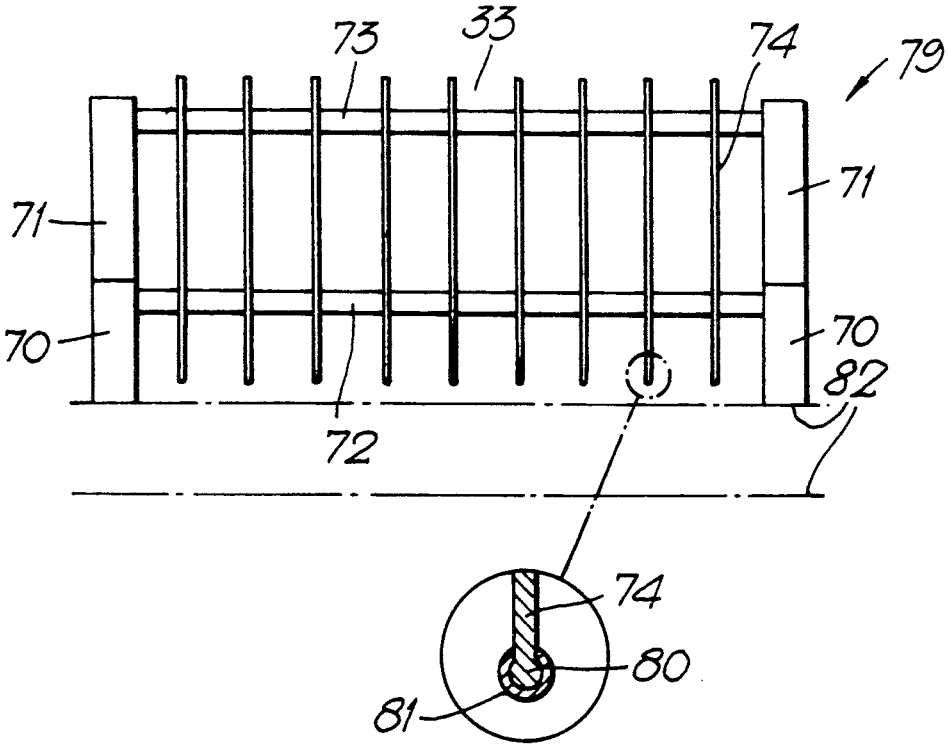
FIG. 5 is a sectional elevation, partly to an enlarged scale, taken on the line V—V of FIG. 4.

In FIGS. 4 and 5 there is shown a part of a third embodiment of an apparatus according to the present invention which is generally similar to those of FIGS. 1 and 2 and FIG. 3 and which for this reason will not be described in detail, like reference numerals indicating like parts.

In the construction of FIGS. 4 and 5, however, instead of employing a drum 24 to provide the endless belt 26 with a curved portion 28, the curved portion 28 is produced by the use of guide means 79 comprising a pair of transversely spaced apart shorter posts 70 and a pair of transversely spaced apart taller posts 71, the latter being longitudinally spaced from the posts 70. The pairs of posts 70,71, which are themselves mounted on a base 78, respectively carry horizontal bars or supports 72, 73. A plurality (e.g. nine) of vertically extending stationary guide members or plates 74 are carried by the supports 72, 73 and are horizontally spaced apart. Each of the stationary guide members 74, which may be made of stainless steel, has an arcuate or other curved portion 75 (not necessarily of constant curvature) and a substantially flat portion 76 which merges smoothly into the curved portion 75 by way of radiused portions 77. The stationary guide members 74 form with the curved portion 28 of the endless belt 26 the paths 33 for the passage of the objects 11 therethrough.

Each of the stationary guide members 74 has a circumferential portion 80 which is part-circular in cross-section and on which is slidably mounted a cover member 81 of a low friction material such as polytetrafluoroethylene. Each cover member 81 has a cut-away portion (not shown) to enable it to be positioned on its respective stationary guide member 74. Each cover member 81, moreover, is of substantially tubular form so as to fit snugly over the respective circumferential portion 80.

In operation, the objects 11 from the horizontally extending endless belt 20 (not shown in FIGS. 4 and 5) pass to the inlet portion 34 of each of the paths 33 and are forced centrifugally against the belt 26, the latter frictionally engaging the cover members 81 so as to cause them to move over their stationary guide members 74. The objects 11 are thus carried to the vertically disposed outlet portions 35 of the paths 33 whence they fall under gravity to sorting means such as shown in FIG. 1. Possible axes of the scanning cameras 46, 47 are indicated at 82.

The construction shown in FIGS. 4 and 5 provides a larger space 23 through which debris may fall and allows the guide means 70–81 to be brought closer to the camera axes 82 than is possible when a drum 24 is used.

It is not absolutely necessary to arrange that any part of the guide means 70–81 is movable, although the arrangement described above is preferred. Thus the cover members 81 could, if desired, be dispensed with and replaced by a layer of very low friction material on the circumference of each stationary guide member 74, or the latter could be made entirely of such material.

In the construction of FIGS. 4 and 5, the pulley 30 is directly driven by a motor 83.

What is claimed is:

1. Apparatus for sorting objects comprising an endless belt; guide means which are in contact with the belt and which cause the latter to have a curved portion; means for forming at least one path between the guide means and the curved portion of the belt for the passage of the objects therethrough, the path having an inlet portion arranged to receive objects which have travelled thereto along a trajectory which has a substantial horizontal component at the inlet portion, and the path having a substantially vertically disposed outlet portion through which the objects are discharged substantially vertically so as to fall under gravity; feeding means for feeding the objects to the inlet portion of the path; means for driving the belt so that objects passing into the path through the inlet portion thereof are centrifugally forced against the belt and carried thereby to the outlet portion thereof; viewing means, disposed below the outlet portion, for viewing the objects as they fall under gravity from the outlet portion; and separator means, controlled by the viewing means, for effecting separation between desired and undesired objects.

2. Apparatus as claimed in claim 1 in which the guide means comprises a drum which has a plurality of circumferentially extending grooves which, together with the said belt, form a plurality of the said paths.

3. Apparatus as claimed in claim 1 in which the guide means comprises at least one stationary guide member provided with a cover member which is movable with respect to its stationary guide member, the cover member being engaged by the belt so as to be frictionally driven thereby over the respective stationary guide member.

4. Apparatus as claimed in claim 1 in which the belt is stiffer axially of the guide means than it is circumferentially thereof.

5. Apparatus as claimed in claim 1 in which the said feeding means comprises a second endless belt having a substantially horizontal run between whose downstream end and the inlet portion of said path there is a space through which undesired objects and other material can be removed, and means for driving the second endless belt, the remaining objects passing across said space, on the said trajectory, from the second endless belt, to the inlet portion.

6. Apparatus as claimed in claim 5 in which there are divider means disposed transversely of the horizontal run for dividing the second endless belt into a plurality of separate longitudinally extending paths through which the objects may travel to corresponding paths which extend circumferentially of a portion of the guide means, there being alignment means for maintaining the paths on the horizontal run in operative alignment with those extending circumferentially of a portion of the guide means.

7. Apparatus as claimed in claim 6 in which the alignment means comprise means for preventing transverse movement of the second endless belt.

8. Apparatus as claimed in claim 6 in which the divider means comprise a plurality of endless bands having substantially horizontal runs which are spaced apart transversely of the second endless belt so as to constitute side walls of the paths on the second endless belt, the endless bands and the second endless belt being driven at substantially the same speed.

9. A method of sorting objects comprising feeding the objects to an inlet portion of at least one path between an endless belt and guide means by means of which the endless belt is given a curved portion, the objects being so fed along a trajectory which has a substantial horizontal component at the said inlet portion; the path having a substantially vertically disposed outlet portion through which the objects are discharged substantially vertically so as to fall under gravity, driving the belt so that objects passing into the path through the inlet portion thereof are centrifugally forced against the belt and carried thereby to the respective outlet portion; viewing the objects as they fall under gravity from the outlet portion from a position below the outlet portion; and effecting separation between desired and undesired objects in dependence upon said viewing.

10. A sorting machine comprising an endless belt having a substantially horizontal run; drive means for driving the endless belt; a plurality of endless bands which are spaced apart transversely of the horizontal run for dividing the latter into a plurality of separate longitudinally extending paths for objects; a plurality of ejectors disposed downstream of the endless belt for removing undesired objects; grooved pulleys in whose grooves the endless bands run so as to maintain the paths and the ejectors in operative alignment; and means for delivering objects to upstream portions of said paths so that in operation objects are carried by the endless belt to downstream portions of said paths where they leave the endless belt and subsequently pass the ejectors.

11. Apparatus for sorting objects comprising an endless belt; a drum which is in contact with the belt and which causes the latter to have a curved portion; the drum having a plurality of circumferentially extending grooves which, together with the said belt, form a plurality of paths between the drum and the curved portion of the belt for the passage of the objects therethrough, each path having an inlet portion arranged to receive objects which have travelled thereto along a trajectory which has a substantial horizontal component at the inlet portion, and each path having a substantially vertically disposed outlet portion; feeding means for feeding the objects to the inlet portion of each path; means for driving the belt so that objects passing into each path through the inlet portion thereof are centrifugally forced against the belt and carried thereby to the outlet portion thereof; and means for sorting the objects as they fall under gravity from each outlet portion.

12. Apparatus for sorting objects comprising an endless belt; at least one stationary guide member provided with a cover member which is movable with respect to its stationary guide member, the cover member being engaged by the belt so as to be frictionally driven thereby over the respective stationary guide member, the stationary guide member causing the belt to have a curved portion; means forming at least one path between the stationary guide member and the curved portion of the belt for the passage of the objects therethrough, the path having an inlet portion arranged to receive objects which have travelled thereto along a trajectory which has a substantial horizontal component at the inlet portion, and the path having a substantially vertically disposed outlet portion; feeding means for feeding the objects to the inlet portion of the path; means for driving the belt so that objects passing into the path through the inlet portion thereof are centrifugally forced against the belt and carried thereby to the outlet portion thereof; and means for sorting the objects as they fall under gravity from the outlet portion.

13. Apparatus for sorting objects comprising an endless belt; guide means which are in contact with the belt and which cause the latter to have a curved portion; means forming at least one path between the guide means and the curved portion of the belt for the passage of the objects therethrough, the path having an inlet portion arranged to receive objects which have travelled thereto along a trajectory which has a substantial horizontal component at the inlet portion, and the path having a substantially vertically disposed outlet portion; feeding means for feeding the objects to the inlet portion of the path, said feeding means comprising a second endless belt having a substantially horizontal run between whose downstream end and the inlet portion of said path there is a space through which undesired objects and other material can be removed, and means for driving the second endless belt, the remaining objects passing across said space, on the said trajectory, from the second endless belt, to the inlet portion; means for driving the belt so that objects passing into the path through the inlet portion thereof are centrifugally forced against the belt and carried thereby to the outlet portion thereof; and means for sorting the objects as they fall under gravity from the outlet portion.

14. Apparatus as claimed in claim 13 in which there are divider means disposed transversely of the horizontal run for dividing the second endless belt into a plurality of separate longitudinally extending paths through which the objects may travel to corresponding paths which extend circumferentially of a portion of the guide means, there being alignment means for maintaining the paths on the horizontal run in operative alignment with those extending circumferentially of a portion of the guide means.

15. Apparatus as claimed in claim 14 in which the alignment means comprise means for preventing transverse movement of the second endless belt.

16. Apparatus as claimed in claim 14 in which the divider means comprise a plurality of endless bands having substantially horizontal runs which are spaced apart transversely of the second endless belt so as to constitute side walls of the paths on the second endless belt, the endless bands and the second endless belt being driven at substantially the same speed.

* * * * *